US005902776A

United States Patent [19]

Dohner et al.

[11] Patent Number: 5,902,776

[45] Date of Patent: May 11, 1999

[54] ADDITIVE COMPOSITIONS FOR LUBRICANTS AND FUNCTIONAL FLUIDS

[75] Inventors: Brent R. Dohner, Concord; James A. Supp, Parma, both of Ohio

[73] Assignee: The Lubrizol Corporation, Wickliffe, Ohio

[21] Appl. No.: 09/074,275

[22] Filed: May 7, 1998

Related U.S. Application Data

[63] Continuation of application No. 08/709,232, Sep. 3, 1996, abandoned, which is a continuation of application No. 08/532,344, Sep. 19, 1995, abandoned.

[51] Int. Cl.[6] ..... C10M 141/10; C10M 141/08

[52] U.S. Cl. ..... 508/376; 508/375; 508/379; 508/437; 508/444

[58] Field of Search ..... 508/375, 376, 508/444

[56] References Cited

U.S. PATENT DOCUMENTS

| | | | |
|---|---|---|---|
| 2,897,152 | 7/1959 | Elliott et al. | 508/444 |
| 3,687,848 | 8/1972 | Colclough et al. | 508/444 |
| 3,770,854 | 11/1973 | Morris et al. | 252/46.6 |
| 3,833,496 | 9/1974 | Malec | 508/444 |
| 3,835,202 | 9/1974 | Elliott | 252/46.6 |
| 3,876,550 | 4/1975 | Holubec | 252/47.5 |
| 3,890,363 | 6/1975 | Malec | 508/444 |
| 4,263,150 | 4/1981 | Clason et al. | 252/32.7 |
| 4,289,635 | 9/1981 | Schroeck | 252/32.7 |
| 4,308,154 | 12/1981 | Clason et al. | 252/32.7 |
| 4,322,479 | 3/1982 | Forsberg | 428/471 |
| 4,417,990 | 11/1983 | Clason et al. | 252/32.7 |
| 4,554,085 | 11/1985 | Zinbo et al. | 252/46.6 |
| 4,609,480 | 9/1986 | Hata et al. | 252/47.5 |
| 4,758,362 | 7/1988 | Butke | 252/47.5 |
| 5,034,141 | 7/1991 | Beltzer et al. | 252/32.7 |
| 5,034,142 | 7/1991 | Habeeb et al. | 252/32.7 |
| 5,158,698 | 10/1992 | Jolley et al. | 252/47.5 |
| 5,256,321 | 10/1993 | Todd | 252/32.007 |
| 5,342,531 | 8/1994 | Walters et al. | 252/46.6 |
| 5,693,598 | 12/1997 | Abraham et al. | 508/444 |

FOREIGN PATENT DOCUMENTS

| | | | |
|---|---|---|---|
| 0 528 610 A1 | 2/1993 | European Pat. Off. | 141/10 |

*Primary Examiner*—Ellen M. McAvoy
*Attorney, Agent, or Firm*—David M. Shold

[57] ABSTRACT

This invention relates to a composition, comprising:

(A) a metal, amine or ammonium salt of a compound represented by the formula (A-1)

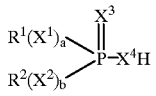

wherein in Formula (A-I), $X^1$, $X^2$ and $X^3$ and $X^4$ are independently O or S, $X^1$ and $X^2$ can be $NR^3$, a and b are independently zero or 1, and $R^1$, $R^2$ and $R^3$ are independently hydrocarbyl groups and $R^3$ can be hydrogen; and (B) a thiocarbamate represented by the formula $$R^1R^2N—C(X)S—(CR^3R^4)_aZ \quad \text{(B-I)}$$

wherein in Formula (B-I), $R^1$, $R^2$, $R^3$ and $R^4$ are independently hydrogen or hydrocarbyl groups, provided that at least one of $R^1$ and $R^2$ is a hydrocarbyl group; X is O or S; a is 1 or 2; and Z is an activating group, a hydrocarbyl group, a hydroxy hydrocarbyl group, a hetero group, or a —SC(X)—$NR^1R^2$ group; provided that when a is 2, Z is an activating group. These compositions are useful in providing lubricating oil compositions and functional fluids, especially engine lubricating oils, with enhanced antiwear properties, and in one embodiment enhanced antioxidant properties.

13 Claims, No Drawings

ADDITIVE COMPOSITIONS FOR LUBRICANTS AND FUNCTIONAL FLUIDS

This is a continuation of application Ser. No. 08/709,232, now abandoned, filed Sep. 3, 1996 which is a continuation of Ser. No. 08/532,344 filed Sep. 19, 1995, now abandoned, the disclosures of which are incorporated herein by reference.

TECHNICAL FIELD

This invention relates to additive compositions for lubricants and functional fluids and, more particularly, to compositions comprising an organic phosphorus-containing salt and a thiocarbamate which are useful in providing enhanced antiwear properties to lubricants and functional fluids, especially engine lubricating oils.

BACKGROUND OF THE INVENTION

Engine lubricating oils require the presence of additives to protect the engine from wear. For almost 40 years, the principal antiwear additive for engine lubricating oils has been zinc dialkyl dithiophosphate (ZDDP). However, ZDDP is typically used in the lubricating oil at a sufficient concentration to provide a phosphorus content of 0.12% by weight or higher in order to pass required industry standard tests for antiwear. Since phosphates may result in the deactivation of emission control catalysts used in automotive exhaust systems, a reduction in the amount of phosphorus-containing additives (e.g., ZDDP) in the oil would be desirable. The problem sought to be overcome is to provide for a reduction in the amount of phosphorus-containing additive in the lubricating oil and yet provide the lubricating oil with desired antiwear properties.

The use of metal salts of phosphorodithioic acids as additives for lubricants is disclosed in U.S. Pat. Nos. 4,263,150; 4,289,635; 4,308,154; 4,322,479; and 4,417,990. Amine salts of such acids are disclosed as being useful as additives for grease compositions in U.S. Pat. No. 5,256,321.

U.S. Pat. No. 4,758,362 discloses the addition of a carbamate to a low phosphorus or phosphorus free lubricating oil composition to provide such a composition with enhanced extreme-pressure and antiwear properties.

U.S. Pat. No. 5,034,141 discloses that improved antiwear results can be obtained by combining a thiodixanthogen (e.g., octylthiodixanthogen) with a metal thiophosphate (e.g., ZDDP). U.S. Pat. No. 5,034,142 discloses the addition of a metal alkoxyalkylxanthate (e.g., nickel ethoxyethylxanthate), a dixanthogen (e.g., diethoxyethyl dixanthogen) and a metal thiophosphate (e.g., ZDDP) to a lubricant to improve antiwear.

SUMMARY OF THE INVENTION

This invention relates to a composition, comprising:

(A) a metal, amine or ammonium salt of a compound represented by the formula (A-1)

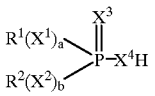

wherein in Formula (A-I), $X^1$, $X^2$ and $X^3$ and $X^4$ are independently O or S, $X^1$ and $X^2$ can be $NR^3$, a and b are independently zero or 1, and $R^1$, $R^2$ and $R^3$ are independently hydrocarbyl groups and $R^3$ can be hydrogen; and (B) a thiocarbamate represented by the formula $$R^1R^2N—C(X)S—(CR^3R^4)_aZ \quad \text{(B-I)}$$

wherein in Formula (B-I), $R^1$, $R^2$, $R^3$ and $R^4$ are independently hydrogen or hydrocarbyl groups, provided that at least one of $R^1$ and $R^2$ is a hydrocarbyl group; X is O or S; a is 1 or 2; and Z is an activating group, a hydrocarbyl group, a hydroxy hydrocarbyl group, a hetero group, or a —SC(X)—$NR^1R^2$ group, provided that when a is 2, Z is an activating group. In one embodiment, this invention relates to a process comprising mixing the foregoing components (A) and (B).

The inventive compositions are useful in providing lubricating compositions and functional fluids, especially engine lubricating oils, with enhanced antiwear properties. In one embodiment, these lubricating compositions and functional fluids are characterized by reduced phosphorus levels when compared to those in the prior art, and yet they have sufficient antiwear properties to pass industry standard tests for antiwear. In one embodiment, the inventive compositions also provide such lubricating compositions and functional fluids with enhanced antioxidant properties.

DESCRIPTION OF THE PREFERRED EMBODIMENTS

As used in this specification and in the appended claims, the term "hydrocarbyl" denotes a group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based," "aryl-based," and the like have meanings analogous to the above with respect to alkyl groups, aryl groups and the like.

The term "hydrocarbon-based" has the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25EC.

(A) Phosphorus-Containing Salt.

The phosphorus-containing acids useful in making the salts (A) of the invention can be represented by the formula (A-1)

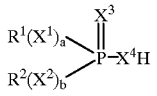

wherein in Formula (A-I), $X^1$, $X^2$, $X^3$ and $X^4$ are independently oxygen or sulfur, $X^1$ and $X^2$ can be $NR^3$, a and b are independently zero or one, $R^1$, $R^2$ and $R^3$ are independently hydrocarbyl groups, and $R^3$ can be hydrogen. Illustrative examples of useful phosphorus-containing acids include:

1. Dihydrocarbyl phosphinodithioic acids corresponding to the formula

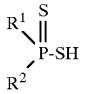

c

2. S-hydrocarbyl hydrocarbyl phosphonotrithioic acids corresponding to the formula

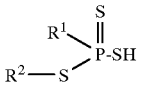

3. O-hydrocarbyl hydrocarbyl phosphonodithioic acids corresponding to the formula c 4. S,S-dihydrocarbyl phosphorotetrathioic acids corresponding to the formula r 5. O,S-dihydrocarbyl phosphorotrithioic acids corresponding to the formula

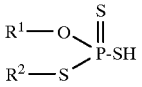

6. O,O-dihydrocarbyl phosphorodithioic acids corresponding to the formula (A-IA)

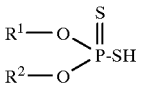

Phosphorus-containing acids of Formula (A-IA) are readily obtainable by the reaction of phosphorus pentasulfide ($P_2S_5$) and an alcohol or a phenol. The reaction involves mixing at a temperature of about 20° C. to about 200° C., four moles of alcohol or a phenol with one mole of phosphorus pentasulfide. Hydrogen sulfide is liberated in this reaction. The oxygen-containing analogs of these acids are conveniently prepared by treating the dithioic acid with water or steam which, in effect, replaces one or both of the sulfur atoms.

Useful phosphorus-containing acids are phosphorus- and sulfur-containing acids. These include those acids wherein at least one $X^3$ or $X^4$ is sulfur, and in one embodiment both $X^3$ and $X^4$ are sulfur, at least one $X^1$ or $X^2$ is oxygen or sulfur, and in one embodiment both $X^1$ and $X^2$ are oxygen, and a and b are each 1. Mixtures of these acids may be employed in accordance with this invention.

$R^1$ and $R^2$ are independently hydrocarbyl groups that are preferably free from acetylenic unsaturation and usually also from ethylenic unsaturation and in one embodiment have from about 1 to about 50 carbon atoms, and in one embodiment from about 1 to about 30 carbon atoms, and in one embodiment from about 3 to about 18 carbon atoms, and in one embodiment from about 3 to about 8 carbon atoms. Each $R^1$ and $R^2$ can be the same as the other, although they may be different and either or both may be mixtures. Examples of $R^1$ and $R^2$ groups include isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and mixtures thereof. Particular examples of useful mixtures include, for example, isopropyl/n-butyl; isopropyl/secondary butyl; isopropyl/4-methyl-2-pentyl; isopropyl/2-ethyl-1-hexyl; isopropyl/isooctyl; isopropyl/decyl; isopropyl/dodecyl; and isopropyl/tridecyl.

$R^3$ can be hydrogen or a hydrocarbyl group (e.g., alkyl) of 1 to about 12 carbon atoms, and in one embodiment 1 to about 4 carbon atoms.

The preparation of the metal salts of the phosphorus-containing acids may be effected by reaction with the metal or metal oxide. Simply mixing and heating these two reactants is sufficient to cause the reaction to take place and the resulting product is sufficiently pure for the purposes of this invention. Typically the formation of the salt is carried out in the presence of a diluent such as an alcohol, water or diluent oil. Neutral salts are prepared by reacting one equivalent of metal oxide or hydroxide with one equivalent of the acid. Basic metal salts are prepared by adding an excess of (more than one equivalent) the metal oxide or hydroxide to one equivalent of phosphorodithioic acid.

The metal salts of phosphorus-containing acids (A) which are useful in this invention include those salts containing Group IA, IIA or IIB metals, aluminum, lead, tin, iron, molybdenum, manganese, cobalt, nickel or bismuth. Zinc is an especially useful metal. These salts can be neutral salts or basic salts. Examples of useful metal salts of phosphorus-containing acids, and methods for preparing such salts are found in the prior art such as U.S. Pat. Nos. 4,263,150, 4,289,635; 4,308,154; 4,322,479; 4,417,990; and 4,466,895, and the disclosures of these patents are hereby incorporated by reference. These salts include the Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The following examples illustrate the preparation of useful metal salts of the phosphorus-containing acid (A). In the following examples as well as throughout the specification and in the claims, unless otherwise indicated, all parts and percentages are by weight, all temperatures are in degrees Celsius, and all pressures are atmospheric.

EXAMPLE A-1

A phosphorodithioic acid is prepared by reacting finely powdered phosphorus pentasulfide (4.37 moles) with an alcohol mixture containing 11.53 moles of isopropyl alcohol and 7.69 moles of isooctanol. The phosphorodithioic acid obtained in this manner has an acid number of about 178–186 and contains 10.0% phosphorus and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

EXAMPLE A-2

(a) A phosphorodithioic acid is prepared by reacting a mixture of 1560 parts (12 moles) of isooctyl alcohol and 180 parts (3 moles) of isopropyl alcohol with 756 parts (3.4 moles) of phosphorus pentasulfide. The reaction is conducted by heating the alcohol mixture to about 55° C. and thereafter adding the phosphorus pentasulfide over a period of 1.5 hours while maintaining the reaction temperature at about 60–75° C. After all of the phosphorus pentasulfide is added, the mixture is heated and stirred for an additional hour at 70–75° C., and thereafter filtered through a filter aid.

(b) Zinc oxide (282 parts) is charged to a reactor with 278 parts of mineral oil. The phosphorodithioic acid prepared in (a) (2305 parts) is charged to the zinc oxide slurry over a period of 30 minutes with an exotherm to 60° C. The mixture then is heated to 80° C. and maintained at this temperature for 3 hours. After stripping to 100° C. and 6 mm Hg, the mixture is filtered twice through filter aid, and the filtrate is the desired oil solution of the zinc salt containing 10% oil, 7.97% zinc; 7.21% phosphorus; and 15.64% sulfur.

EXAMPLE A-3

(a) Isopropyl alcohol (396 parts, 6.6 moles) and 1287 parts (9.9 moles) of isooctyl alcohol are charged to a reactor and heated with stirring to 59° C. Phosphorus pentasulfide (833 parts, 3.75 moles) is then added under a nitrogen sweep. The addition of the phosphorus pentasulfide is completed in about 2 hours at a reaction temperature between 59–63° C. The mixture then is stirred at 45–63° C. for about 1.45 hours and filtered. The filtrate is the desired phosphorodithioic acid.

(b) A reactor is charged with 312 parts (7.7 equivalents) of zinc oxide and 580 parts of mineral oil. While stirring at room temperature, the phosphorodithioic acid prepared in (a) (2287 parts, 6.97 equivalents) is added over a period of about 1.26 hours with an exotherm to 54° C. The mixture is heated to 78° C. and maintained at 78–85° C. for 3 hours. The reaction mixture is vacuum stripped to 100° C. at 19 mm Hg. The residue is filtered through filter aid, and the filtrate is an oil solution (19.2% oil) of the desired zinc salt containing 7.86% zinc, 7.76% phosphorus and 14.8% sulfur.

EXAMPLE A-4

The general procedure of Example A-3 is repeated except that the mole ratio of isopropyl alcohol to isooctyl alcohol is 1:1. The product obtained in this manner is an oil solution (10% oil) of the zinc phosphorodithioate containing 8.96% zinc, 8.49% phosphorus and 18.05% sulfur.

EXAMPLE A-5

(a) A mixture of 420 parts (7 moles) of isopropyl alcohol and 518 parts (7 moles) of n-butyl alcohol is prepared and heated to 60° C. under a nitrogen atmosphere. Phosphorus pentasulfide (647 parts, 2.91 moles) is added over a period of one hour while maintaining the temperature at 65–77° C. The mixture is stirred an additional hour while cooling. The material is filtered through filter aid, and the filtrate is the desired phosphorodithioic acid.

(b) A mixture of 113 parts (2.76 equivalents) of zinc oxide and 82 parts of mineral oil is prepared and 662 parts of the phosphorodithioic acid prepared in (a) are added over a period of 20 minutes. The reaction is exothermic and the temperature of the mixture reaches 70° C. The mixture then is heated to 90° C. and maintained at this temperature for 3 hours. The reaction mixture is stripped to 105° C. and 20 mm Hg. The residue is filtered through filter aid, and the filtrate is the desired product containing 10.17% phosphorus, 21.0% sulfur and 10.98% zinc.

EXAMPLE A-6

A mixture of 29.3 parts (1.1 equivalents) of ferric oxide and 33 parts of mineral oil is prepared, and 273 parts (1.0 equivalent) of the phosphorodithioic acid prepared in Example A-5(a) are added over a period of 2 hours. The reaction is exothermic during the addition, and the mixture is thereafter stirred an additional 3.5 hours while maintaining the mixture at 70° C. The product is stripped to 105° C. at 10 mm Hg and filtered through a filter aid. The filtrate is a black-green liquid containing 4.9% iron and 10.0% phosphorus.

EXAMPLE A-7

A mixture of 239 parts of the product of Example A-5(a), 11 parts of calcium hydroxide and 10 parts of water is heated to about 80° C. and maintained at this temperature for 6 hours. The product is stripped to 105° C./10 mm Hg and filtered through a filter aid. The filtrate is a molasses-colored liquid containing 2.19% calcium.

EXAMPLE A-8

(a) A mixture of 105.6 grams (1.76 moles) of isopropyl alcohol and 269.3 grams (2.64 moles) of 4-methyl-2-pentanol is prepared and heated to 70° C. Phosphorus pentasulfide (222 grams, 1 mole) is added to the alcohol mixture while maintaining the temperature at 70° C. One mole of hydrogen sulfide is liberated. The mixture is maintained at 70° C. for an additional four hours. The mixture is filtered through diatomaceous earth to yield a green liquid product having an acid number in the range of 179–189.

(b) 44.6 grams (1.09 equivalents) of ZnO are added to diluent oil to form a slurry. One equivalent (based upon the measured acid number) of the phosphorodithioic acid prepared in (a) are added dropwise to the ZnO slurry. The reaction is exothermic. The reaction mixture is stripped to 100° C. and 20 mm Hg to remove water of reaction and excess alcohol. The residue is filtered through diatomaceous earth. The filtrate, which is a viscous liquid, is diluted with diluent oil to provide a final product having a 9.5% by weight phosphorus content.

EXAMPLE A-9

(a) A mixture of 317.33 grams (5.28 moles) of 2-propanol and 359.67 grams (3.52 moles) of 4-methyl-2-pentanol is prepared and heated to 60° C. Phosphorus pentasulfide (444.54 grams, 2.0 moles) is added to the alcohol mixture while maintaining the temperature at 60° C. Two moles of hydrogen sulfide are liberated and trapped with a 50% aqueous sodium hydroxide trap. The mixture is heated to and maintained at 70° C. for two hours. The mixture is cooled to room temperature and filtered through diatomaceous earth to yield a liquid green product having an acid number in the range of 193–203.

(b) 89.1 grams (1.1 moles) of ZnO are added to 200 ml of toluene. 566.6 grams (2.0 equivalents based on acid number) of the product from part (a) are added dropwise to the ZnO/toluene mixture. The resulting reaction is exothermic. The reaction mixture is stripped to 70° C. and 20 mm Hg to remove water of reaction, toluene and excess alcohol. The residue is filtered through diatomaceous earth. The filtrate, which is the desired product, is a yellow viscous liquid.

When the phosphorus-containing salt (A) is an ammonium salt, the salt is considered as being derived from ammonia ($NH_3$) or an ammonia yielding compound such as $NH_4OH$. Other ammonia yielding compounds will readily occur to those skilled in the art.

When the phosphorus-containing salt (A) is an amine salt, the salt may be considered as being derived from amines. The amines may be primary, secondary or tertiary amines, or mixtures thereof. Hydrocarbyl groups of the amines may be aliphatic, cycloaliphatic or aromatic. These include alkyl and alkenyl groups. In one embodiment the amine is an alkylamine wherein the alkyl group contains from 1 to about 24 carbon atoms.

In one embodiment, the amines are primary hydrocarbyl amines containing from about 2 to about 30, and in one embodiment about 4 to about 20 carbon atoms in the hydrocarbyl group. The hydrocarbyl group may be saturated or unsaturated. Representative examples of primary saturated amines are the alkyl amines such as methyl amine, n-butylamine, n-hexylamine; those known as aliphatic primary fatty amines, for example, the commercially known "Armeen" primary amines (products available from Akzo Chemicals, Chicago, Ill.). Typical fatty amines include amines such as, n-octylamine, n-dodecylamine, n-tetradecylamine, n-octadecylamine (stearylamine), octadecenyl amine (oleylamine), etc. Also suitable are mixed fatty amines such as Akzo's Armeen-C, Armeen-O, Armeen-OD, Armeen-T, Armeen-HT, Armeen S and Armeen SD, all of which are fatty amines of varying purity.

In one embodiment, the amine salts of this invention are those derived from tertiary-aliphatic primary amines having from about 4 to about 30, and in one embodiment about 6 to about 24, and in one embodiment about 8 to about 24 carbon atoms in the aliphatic group.

Usually the tertiary-aliphatic primary amines are monoamines, and in one embodiment alkylamines represented by the formula

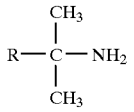

wherein R is a hydrocarbyl group containing from 1 to about 30 carbon atoms. Such amines are illustrated by tertiary-butylamine, 1-methyl-1-amino-cyclohexane, tertiary-octyl primary amine, tertiary-tetradecyl primary amine, tertiary-hexadecyl primary amine, tertiary-octadecyl primary amine, tertiary-octacosanyl primary amine.

Mixtures of tertiary alkyl primary amines are also useful for the purposes of this invention. Illustrative of amine mixtures of this type are "Primene 81R" which is a mixture of $C_{11-14}$ tertiary alkyl primary amines and "Primene JMT" which is a similar mixture of $C_{18-22}$ tertiary alkyl primary amines (both are available from Rohm and Haas). The tertiary alkyl primary amines and methods for their preparation are known to those of ordinary skill in the art. The tertiary-alkyl primary amine useful for the purposes of this invention and methods for their preparation are described in U.S. Pat. No. 2,945,749 which is hereby incorporated by reference for its teachings in this regard.

Primary amines in which the hydrocarbyl group comprises olefinic unsaturation also are useful. Thus, the hydrocarbyl groups may contain one or more olefinic unsaturation depending on the length of the chain, usually no more than one double bond per 10 carbon atoms. Representative amines are dodecenylamine, oleylamine and linoleylamine. Such unsaturated amines are available under the Armeen tradename.

Secondary amines include dialkylamines having two of the above hydrocarbyl, preferably alkyl or alkenyl groups described for primary amines including such commercial fatty secondary amines as Armeen 2C and Armeen HT, and also mixed dialkylamines wherein, for example, one alkyl group is a fatty group and the other alkyl group may be a lower alkyl group (1–7 carbon atoms) such as ethyl, butyl, etc., or the other hydrocarbyl group may be an alkyl group bearing other non-reactive or polar substituents (CN, alkyl, carbalkoxy, amide, ether, thioether, halo, sulfoxide, sulfone) such that the essentially hydrocarbon character of the group is not destroyed.

Tertiary amines such as trialkyl or trialkenyl amines and those containing a mixture of alkyl and alkenyl amines are useful. The alkyl and alkenyl groups are substantially as described above for primary and secondary amines.

Other useful primary amines are the primary etheramines represented by the formula $R''OR'NH_2$ wherein R' is a divalent alkylene group having 2 to about 6 carbon atoms and R" is a hydrocarbyl group of about 5 to about 150 carbon atoms. These primary etheramines are generally prepared by the reaction of an alcohol R"OH wherein R" is as defined hereinabove with an unsaturated nitrile. Typically, the alcohol is a linear or branched aliphatic alcohol with R" having up to about 50 carbon atoms, and in one embodiment up to about 26 carbon atoms, and in one embodiment from about 6 to about 20 carbon atoms. The nitrile reactant can have from about 2 to about 6 carbon atoms, with acrylonitrile being useful. Ether amines are commercially available under the name SURFAM marketed by Mars Chemical Company, Atlanta, Ga. Typical of such amines are those having a molecular weight of from about 150 to about 400. Useful etheramines are exemplified by those identified as SURFAM P14B (decyloxypropylamine), SURFAM P16A (linear $C_{16}$), SURFAM P17B (tridecyloxypropylamine). The hydrocarbyl chain lengths (i.e., $C_{14}$, etc.) of the SURFAM described above and used hereinafter are approximate and include the oxygen ether linkage. For example, a $C_{14}$ SURFAM amine would have the following general formula $$C_{10}H_{21}OC_3H_6NH_2$$

The amines used to form the amine salts may be hydroxyamines. In one embodiment, these hydroxyamines can be represented by the formula

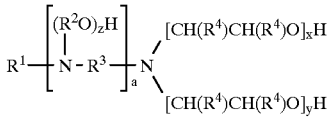

wherein $R^1$ is a hydrocarbyl group generally containing from about 6 to about 30 carbon atoms, $R^2$ is an ethylene or propylene group, $R^3$ is an alkylene group containing up to about 5 carbon atoms, a is zero or one, each $R^4$ is hydrogen or a lower alkyl group, and x, y and z are each independently integers from zero to about 10, at least one of x, y and z being at least 1. The above hydroxyamines can be prepared by techniques well known in the art, and many such hydroxyamines are commercially available. Useful hydroxyamines where in the above formula a is zero include 2-hydroxyethylhexylamine, 2-hydroxyethyloleylamine, bis(2-hydroxyethyl)hexylamine, bis(2-hydroxyethyl) oleylamine, and mixtures thereof. Also included are the comparable members wherein in the above formula at least one of x and y is at least 2.

A number of hydroxyamines wherein a is zero are available from Armak under the general trade designation "Ethomeen" and "Propomeen." Specific examples include "Ethomeen C/15" which is an ethylene oxide condensate of a coconut fatty amine containing about 5 moles of ethylene oxide; "Ethomeen C/20" and "C/25" which also are ethylene oxide condensation products from coconut fatty amine containing about 10 and 15 moles of ethylene oxide, respectively. "Propomeen O/12" is the condensation product of one mole of oleylamine with 2 moles propylene oxide.

Commercially available examples of alkoxylated amines where a is 1 include "Ethoduomeen T/13" and "T/20" which are ethylene oxide condensation products of N-tallow trimethylene diamine containing 3 and 10 moles of ethylene oxide per mole of diamine, respectively.

The fatty diamines include mono- or dialkyl, symmetrical or asymmetrical ethylene diamines, propane diamines (1,2 or 1,3) and polyamine analogs of the above. Suitable fatty polyamines such as those sold under the name Duomeen are commercially available diamines described in Product Data Bulletin No. 7-10$R_1$ of Armak. In another embodiment, the secondary amines may be cyclic amines such as piperidine, piperazine, morpholine, etc.

The following examples illustrate the preparation of amine salts of the phosphorus-containing acids (A) that can be used with this invention.

EXAMPLE A-10

Phosphorus pentoxide (208 grams) is added at 50° C. to 60° C. to hydroxypropyl O,O'-diisobutyl phosphorodithioate (prepared by reacting 280 grams of propylene oxide with 1184 grams of O,O'-di-isobutyl phosphorodithioic acid at 30° C. to 60° C). The reaction mixture is heated to 80° C. and held at that temperature for 2 hours. To the acidic reaction mixture there is added a stoichiometrically equivalent amount (384 grams) of a commercial aliphatic primary amine at 30° C. to 60° C. The product is filtered. The filtrate has a phosphorus content of 9.31%, a sulfur content of 11.37%, a nitrogen content of 2.50%, and a base number of 6.9 (bromphenol blue indicator).

EXAMPLE A-11

To 400 parts of O,O'di-(isooctyl) phosphorodithioic acid is added 308 parts of oleylamine (Armeen O— Armak).

(B) Thiocarbamate.

The thiocarbamates (B) are compounds represented by the formula $$R^1R^2N—C(X)S—(CR^3R^4)_aZ \qquad \text{(B-I)}$$

wherein in Formula (B-I), $R^1$, $R^2$, $R^3$ and $R^4$ are independently hydrogen or hydrocarbyl groups, provided that at least one of $R^1$ or $R^2$ is a hydrocarbyl group; X is oxygen or sulfur; a is 1 or 2; and Z is a hydrocarbyl group, a hydroxy hydrocarbyl group, a hetero group (that is, a group attached through a heteroatom such as O, N, or S), an additional —SC(X)—$NR^1R^2$ group, or an activating group.

When a is 2, Z is an activating group. In describing Z as an "activating group," what is meant is a group which will activate an olefin to which it is attached toward nucleophilic addition by, e.g., $CS_2$ or COS derived intermediates. (This is reflective of the method by which this material is normally prepared, by reaction of an activated olefin with $CS_2$ and an amine.) The activating group Z can be, for instance, an ester group, typically but not necessarily a carboxylic ester group of the structure —$COOR^5$. It can also be an ester group based on a non-carbon acid, such as a sulfonic or sulfinic ester or a phosphonic or phosphinic ester. The activating group can also be any of the acids corresponding to the aforementioned esters. Z can also be an amide group, that is, based on the condensation of an acid group, preferably a carboxylic acid group, with an amine. In that case the —$(CR^3R^4)_aZ$ group can be derived from acrylamide. Z can also be an ether group, —$OR^5$; a carbonyl group, that is, an aldehyde or a ketone group; a cyano group, —CN, or an aryl group. In one embodiment Z is an ester group of the structure, —$COOR^5$, where $R^5$ is a hydrocarbyl group. $R^5$ can comprise 1 to about 18 carbon atoms, and in one embodiment 1 to about 6 carbon atoms. In one embodiment $R^5$ is methyl so that the activating group is —$COOCH_3$.

When a is 1, Z need not be an activating group, because the molecule is generally prepared by methods, described below, which do not involve nucleophilic addition to an activated double bond.

When Z is a hydrocarbyl or a hydroxy hydrocarbyl group, a can be 1 or 2. These hydrocarbyl groups can have from 1 to about 30 carbon atoms, and in one embodiment 1 to about 18 carbon atoms, and in one embodiment 1 to about 12 carbon atoms. Examples include methyl, ethyl, propyl, n-butyl, isobutyl, pentyl, isopentyl, heptyl, octyl, 2-ethylhexyl, nonyl, decyl, dodecyl, and corresponding hydroxy-substituted hydrocarbyl groups such as hydroxymethyl, hydroxyethyl, hydroxypropyl, etc.

$R^3$ and $R^4$ can be, independently, hydrogen or methyl or ethyl groups. When a is 2, at least one of $R^3$ and $R^4$ is normally hydrogen so that this compound, in one embodiment, is $R^1R^2N—C(S)S—CR^3HCR^3R^4COOR^5$. In one embodiment the thiocarbamate is $R^1R^2N—C(S)S—CH_2CH_2COOCH_3$. (These materials can be derived from methyl methacrylate and methylacrylate, respectively.) These and other materials containing appropriate activating groups are disclosed in greater detail in U.S. Pat. No. 4,758,362, which is incorporated herein by reference.

The substituents $R^1$ and $R^2$ on the nitrogen atom are likewise hydrogen or hydrocarbyl groups, but at least one should be a hydrocarbyl group. It is generally believed that at least one such hydrocarbyl group is desired in order to provide a measure of oil-solubility to the molecule. However, $R^1$ and $R^2$ can both be hydrogen, provided the other R groups in the molecule provide sufficient oil solubility to the molecule. In practice this means that at least one of the groups $R^3$ or $R^4$ should be a hydrocarbyl group of at least 4 carbon atoms. $R^1$ or $R^2$ can be alkyl groups of 1 to about 18 carbon atoms, and in one embodiment alkyl groups of 1 to about 8 carbon atoms.

In one embodiment the thiocarbamate is a compound represented by the formula (B-IA)

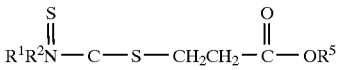

wherein in Formula (B-IA) $R^1$, $R^2$ and $R^5$ are independently alkyl groups of 1 to about 18 carbon atoms, and in one embodiment 1 to about 12 carbon atoms, and in one embodiment 1 to about 8 carbon atoms, and in one embodiment 1 to about 4 carbon atoms.

In one embodiment the thiocarbamate (B) is S-carbomethoxy-ethyl-N,N-dibutyl dithiocarbamate which can be represented by the formula

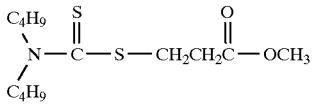

Materials of this type can be prepared by a process described in U.S. Pat. No. 4,758,362. Briefly, these materials are prepared by reacting an amine, carbon disulfide or carbonyl sulfide, or source materials for these reactants, and a reactant containing an activated, ethylenically-unsaturated bond or derivatives thereof. These reactants are charged to a reactor and stirred, generally without heating, since the reaction is normally exothermic. Once the reaction reaches the temperature of the exotherm (typically 40–65EC), the reaction mixture is held at the temperature to insure complete reaction. After a reaction time of typically 3–5 hours, the volatile materials are removed under reduced pressure and the residue is filtered to yield the final product.

The relative amounts of the reactants used to prepare these compounds are not critical. The charge ratios to the reactor can vary where economics and the amount of the product desired are controlling factors. Thus, the molar charge ratio of the amine to the $CS_2$ or COS reactant to the ethylenically unsaturated reactant may vary in the ranges 5:1:1 to 1:5:1 to 1:1:5. In one embodiment, the charge ratios of these reactants is 1:1:1.

In the case where a is 1, the activating group Z is separated from the sulfur atom by a methylene group. Materials of this type can be prepared by reaction of sodium dithiocarbamate with a chlorine-substituted material. Such materials are described in greater detail in U.S. Pat. No. 2,897,152, which is incorporated herein by reference.

The following example illustrates the preparation of a thiocarbamate (B) that can be used with this invention.

EXAMPLE B-1

Carbon disulfide (79.8 grams, 1.05 moles) and methyl acrylate (86 grams, 1.0 mole) are placed in a reactor and stirred at room temperature. Di-n-butyl amine (129 grams, 1.0 mole) is added dropwise to the mixture. The resulting reaction is exothermic, and the di-n-butyl amine addition is done at a sufficient rate to maintain the temperature at 55° C. After the addition of di-n-butyl amine is complete, the reaction mixture is maintained at 55° C. for four hours. The mixture is blown with nitrogen at 85° C. for one hour to remove unreacted starting material. The reaction mixture is filtered through filter paper, and the resulting product is a viscous orange liquid.

Lubricating Compositions Functional Fluids and Concentrates.

The lubricating compositions and functional fluids of the present invention are based on diverse oils of lubricating viscosity, including natural and synthetic lubricating oils and mixtures thereof. The lubricating compositions may be lubricating oils and greases useful in industrial applications and in automotive engines, transmissions and axles. These lubricating compositions are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metalworking lubricants, hydraulic fluids, and other lubricating oil and grease compositions can benefit from the incorporation of the compositions of this invention. The inventive lubricating compositions are particularly effective as engine lubricating oils having enhanced antiwear properties.

The lubricant compositions of this invention employ an oil of lubricating viscosity which is generally present in a major amount (i.e. an amount greater than about 50% by weight). Generally, the oil of lubricating viscosity is present in an amount greater than about 60%, or greater than about 70%, or greater than about 80% by weight of the composition.

The natural oils useful in making the inventive lubricants and functional fluids include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils such as polymerized and interpolymerized olefins (e.g., polybutylenes, polypropylenes, propyleneisobutylene copolymers, etc.); poly(1-hexenes), poly(1-octenes), poly(1-decenes), etc. and mixtures thereof; alkyl-benzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl) silicate, hexyl-(4-methyl-2-pentoxy) disiloxane, poly(methyl) siloxanes, poly-(methylphenyl) siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In one embodiment, component (A) is employed in the lubricant or functional fluid at a concentration in the range of about 0.01% to about 2%, and in one embodiment about 0.1% to about 1.2%, and in one embodiment about 0.2% to about 0.8% by weight based on the total weight of the lubricant or functional fluid. In one embodiment, component (B) is employed in the lubricant or functional fluid at a concentration in the range of about 0.01% to about 2%, and in one embodiment from about 0.1% to about 1%, and in one embodiment from about 0.2% to about 0.8% by weight based on the total weight of the lubricant or functional fluid. In one embodiment, the combined concentration of (A) and (B) in the lubricant or functional fluid is at least about 0.8% by weight, and in one embodiment is in the range of about 0.8% to about 4% by weight, and in one embodiment about 0.8% to about 2% by weight, and in one embodiment about 0.8% to about 1.5% by weight.

The weight ratio of (B):(A) is in one embodiment from about 0.1 to about 10, and in one embodiment about 0.3 to about 5, and in one embodiment from about 0.4 to about 3, and in one embodiment from about 0.5 to about 2.

In one embodiment these lubricating compositions and functional fluids have a phosphorus content of up to about 0.12% by weight, and in one embodiment up to about 0.11% by weight, and in one embodiment up to about 0.1% by weight, and in one embodiment up to about 0.08% by weight, and in one embodiment up to about 0.05% by weight. In one embodiment the phosphorus content is in the range of about 0.01% to about 0.12% by weight, and in one embodiment about 0.01% to about 0.11% by weight, and in one embodiment about 0.02% to about 0.1% by weight and in one embodiment about 0.05% to about 0.1% by weight.

The invention also provides for the use of lubricants and functional fluids containing other additives in addition to components (A) and (B). Such additives include, for example, detergents and dispersants, corrosion-inhibiting agents, antioxidants, viscosity improving agents, extreme pressure (E.P.) agents, pour point depressants, friction modifiers, fluidity modifiers, anti-foam agents, etc.

The inventive lubricating compositions and functional fluids can contain one or more detergents or dispersants of the ash-producing or ashless type. The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions and functional fluids of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in many U.S. Patents including U.S. Pat. Nos. 3,219,666; 4,234,435; and 4,938,881. These include the products formed by the reaction of a polyisobutenyl succinic anhydride with an amine such as a polyethylene amine.

(2) Reaction products of relatively high molecular weight aliphatic or alicyclic halides with amines, preferably oxyalkylene polyamines. These may be characterized as "amine dispersants" and examples thereof are described for example, in the following U.S. Patents: U.S. Pat. Nos. 3,275,554; 3,438,757; 3,454,555; and 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants." The materials described in the following U.S. Patents are illustrative: U.S. Pat. Nos. 3,649,229; 3,697,574; 3,725,277; 3,725,480; 3,726,882; and 3,980,569.

(4) Products obtained by post-treating the amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Patents: U.S. Pat. Nos. 3,639,242; 3,649,229; 3,649,659; 3,658,836; 3,697,574; 3,702,757; 3,703,536; 3,704,308; and 3,708,422.

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Patents: U.S. Pat. Nos. 3,329,658; 3,449,250; 3,519,565; 3,666,730; 3,687,849; and 3,702,300.

The above-noted patents are incorporated by reference herein for their disclosures of ashless dispersants.

The inventive lubricating compositions and functional fluids can contain one or more extreme pressure, corrosion inhibitors and/or oxidation inhibitors. Extreme pressure agents and corrosion- and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters; dithiocarbamate containing amides prepared from dithiocarbamic acid and an acrylamide; alkylene-coupled dithiocarbamates; sulfur-coupled dithiocarbamates. Many of the above-mentioned extreme pressure agents and oxidation-inhibitors also serve as antiwear agents.

Pour point depressants are a useful type of additive often included in the lubricating oils and functional fluids described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. A specific pour point depressant that can be used is the product made by alkylating naphthalene with polychlorinated paraffin and $C_{16}$–$C_{18}$ alpha-olefin. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional antifoam compositions are described in "Foam Control Agents," by Henry T. Kerner (Noyes Data Corporation, 1976), pages 125–162.

Each of the foregoing additives, when used, is used at a functionally effective amount to impart the desired properties to the lubricant or functional fluid. Thus, for example, if an additive is a dispersant, a functionally effective amount of this dispersant would be an amount sufficient to impart the desired dispersancy characteristics to the lubricant or functional fluid. Similarly, if the additive is an extreme-pressure agent, a functionally effective amount of the extreme-pressure agent would be a sufficient amount to improve the extreme-pressure characteristics of the lubricant or functional fluid. Generally, the concentration of each of these additives, when used, ranges from about 0.001% to about 20% by weight, and in one embodiment about 0.01% to about 10% by weight based on the total weight of the lubricant or functional fluid.

Components (A) and (B) of the inventive compositions as well as one of the other above-discussed additives or other additives known in the art can be added directly to the lubricant or functional fluid. In one embodiment, however, they are diluted with a substantially inert, normally liquid organic diluent such as mineral oil, naphtha, benzene, toluene or xylene to form an additive concentrate. These concentrates usually contain from about 1% to about 99% by weight, and in one embodiment about 10% to about 90% by weight of the inventive composition (that is, components (A) and (B)) and may contain, in addition, one or more other additives known in the art or described hereinabove. The remainder of the concentrate is the substantially inert normally liquid diluent.

The following Examples 1–6 illustrate lubricating compositions within the scope of the invention.

| | Wt. % |
|---|---|
| Example 1 | |
| Product of Example A-1 | 0.5 |
| Product of Example B-1 | 0.5 |
| Base oil | Remainder |
| Example 2 | |
| Product of Example A-2 | 0.4 |
| Product of Example B-1 | 0.7 |
| Base oil | Remainder |
| Example 3 | |
| Product of Example A-3 | 0.2 |
| Product of Example B-1 | 0.6 |
| Base oil | Remainder |
| Example 4 | |
| Product of Example A-5 | 0.8 |
| Product of Example B-1 | 0.2 |
| Base oil | Remainder |
| Example 5 | |
| Product of Example A-8 | 1.0 |
| Product of Example B-1 | 0.7 |
| Base oil | Remainder |

-continued

| | Wt. % |
|---|---|
| Example 6 | |
| Product of Example A-9 | 1.0 |
| Product of Example B-1 | 0.6 |
| Base oil | Remainder |

The following Examples 7–10 illustrate concentrates within the scope of the invention.

| | Wt. % |
|---|---|
| Example 7 | |
| Product of Example A-1 | 20 |
| Product of Example D-1 | 20 |
| Mineral Oil | 60 |
| Example 8 | |
| Product of Example A-2 | 30 |
| Product of Example B-1 | 40 |
| Mineral oil | 30 |
| Example 9 | |
| Product of Example A-8 | 10 |
| Product of Example B-1 | 20 |
| Mineral oil | 70 |
| Example 10 | |
| Product of Example A-9 | 20 |
| Product of Example B-1 | 20 |
| Mineral oil | 60 |

Examples 11–13 disclosed in Table I are provided for the purpose of further illustrating lubricating compositions within the scope of the invention. In Table I, all numerical values, except for the concentration of the silicone antifoam agent, are in percent by weight. The concentration of the silicone antifoam agent is in parts per million, ppm.

TABLE I

| Example No. | 11 | 12 | 13 |
|---|---|---|---|
| Base Oil (85% 100N oil + 15% 150N oil) | 82.0 | 82.25 | 82.25 |
| Product of Example B-1 | 0.5 | 0.25 | 0.5 |
| Product of Example A-9 | 0.7 | 0.7 | 0.45 |
| Reaction product of polyisobutenyl succinic anhydride and ethylene polyamine | 1.8 | 1.8 | 1.8 |
| Partially esterified polyisobutenyl succinic anhydride post-treated with polyethylene amines | 0.8 | 0.8 | 0.8 |
| Diluent oil | 11.7 | 11.7 | 11.7 |
| Sulfur monochloride reacted with alpha olefin mixture followed by contact with sodium disulfide | 0.3 | 0.3 | 0.3 |
| Alkylated diphenylamine | 0.5 | 0.5 | 0.5 |
| Calcium overbased sulfur coupled alkylphenol | 0.3 | 0.3 | 0.3 |
| Calcium overbased sulfonate (metal to sulfonate ratio of 1.2) | 0.1 | 0.1 | 0.1 |
| Magnesium overbased sulfonate (metal to sulfonate ratio of 14.7) | 0.3 | 0.3 | 0.3 |
| Sodium overbased alkenyl succinate | 0.1 | 0.1 | 0.1 |
| Olefin copolymer VI improver | 0.7 | 0.7 | 0.7 |

TABLE I-continued

| Example No. | 11 | 12 | 13 |
|---|---|---|---|
| Viscoplex 1-330 (product of Rohm GmbH identified as a polymethacrylate pour point depressant) | 0.2 | 0.2 | 0.2 |
| Silicone antifoam agent, ppm | 18 | 18 | 18 |

Examples 14, 14-C1 and 14-C2 are formulated for the purposes of providing test comparisons using the ASTM Sequence VE Engine Test. Examples 14, 14-C1 and 14-C2 are conventional fully formulated engine lubricating oil compositions which are identical except for the fact that Example 14 contains 0.5% by weight of the product of Example B-I and 0.7% by weight of the product of Example A-9, while Example 14-C1 contains only 0.7% by weight of the product of Example A-9, and Example 14-C2 contains only 0.5% by weight of the product of Example B-1.

The ASTM Sequence VE Engine Test is conducted using a 2.3 L, four-cylinder, overhead cam, fuel injected engine. The test is a cyclic test conducted for a period of 288 hours. There are 72 cycles, each being four hours in length and having three stages. The length of time and operating conditions for each stage are as follows:

| Engine Conditions | Stage I | Stage II | Stage III |
|---|---|---|---|
| Time (min) | 120 | 75 | 45 |
| Speed (rpm) | 2500 | 2500 | 750 |
| Load (kW) | 25 | 25 | 0.75 |
| Oil Temp. (° C.) | 68 | 99 | 46 |

At the end of 288 hours the engine is disassembled and selected parts are rated for wear. The test results are reported below in Table II. In Table II, all numerical values are in mils of wear.

TABLE II

| Example No. | 14 | 14-C1 | 14-C2 |
|---|---|---|---|
| Max. Cam Lobe Wear, mils | 0.8 | 15.5 | 18.4 |
| Avg. Cam Lobe Wear, mils | 0.36 | 10.5 | 13.97 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricant or functional fluid composition, comprising a major amount of an oil of lubricating viscosity and a minor anti-wear amount of:

(A) a metal, amine or ammonium salt of a compound represented by the formula (A-1)

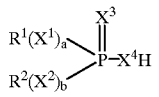

wherein in Formula (A-I), $X^1$, $X^2$ and $X^3$ and $X^4$ are independently O or S, $X^1$ and $X^2$ can be $NR^3$, a and b are independently zero or 1, and $R^1$, $R^2$ and $R^3$ are independently hydrocarbyl groups and $R^3$ can be hydrogen; and (B) a thiocarbamate compound represented by the formula (B-1)

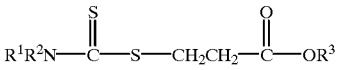

wherein in Formula (B-I), $R^1$, $R^2$, and $R^3$ are independently alkyl groups of 1 to about 4 carbon atoms;

said lubricant or functional fluid being characterized by a phosphorus content of up to about 0. 1% by weight.

2. The composition of claim 1 wherein in Formula (A-I), $X^1$ and $X^2$ are oxygen, $X^3$ and $X^4$ are sulfur, and $R^1$ and $R^2$ are independently hydrocarbyl groups of 1 to about 30 carbon atoms.

3. The composition of claim 1 wherein in Formula (A-I), $R^1$ and $R^2$ are independently isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl or alkylnaphthylalkyl.

4. The composition of claim 1 wherein (A) is a metal salt, said metal being a Group IA, IIA or IIB metal, aluminum, tin, iron, cobalt, lead, molybdenum, manganese, nickel, antimony, bismuth, or a mixture of two or more thereof.

5. The composition of claim 1 wherein (A) is a metal salt, said metal being zinc.

6. The composition of claim 1 wherein (B) is a compound represented by the formula

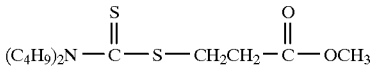

7. The composition of claim 1 further comprising a corrosion-inhibiting agent, detergent, dispersant, antioxidant, viscosity-index improving agent, antiwear agent, extreme-pressure agent, pour-point depressant, friction-modifier, fluidity-modifier, anti-foam agent, or mixture of two or more thereof.

8. A lubricant or functional fluid composition, comprising a major amount of an oil of lubricating viscosity and a minor antiwear amount of:

(A) a zinc salt of a compound represented by the formula (A-IA)

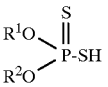

wherein in Formula (A-IA), $R^1$ and $R^2$ are independently isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl; and (B) a compound represented by the formula (B-IA)

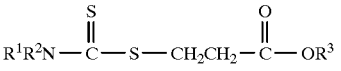

wherein in Formula (B-IA), $R^1$, $R^2$ and $R^3$ are independently alkyl groups of 1 to about 18 carbon atoms;

said lubricant or functional fluid being characterized by a phosphorus content of up to about 0. 1% by weight.

9. A process for making a lubricant or functional fluid, comprising mixing a major amount of an oil of lubricating viscosity and a minor antiwear amount of:

(A) a metal salt of a compound represented by the formula (A-I)

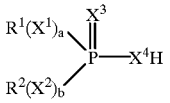

wherein in Formula (A-I), $X^1$, $X^2$ and $X^3$ and $X^4$ are independently O or S, $X^1$ and $X^2$ can be $NR^3$, a and b are independently zero or 1, and $R^1$, $R^2$ and $R^3$ are independently hydrocarbyl groups and $R^3$ can be hydrogen; and (B) a thiocarbamate compound represented by the formula (B-I)

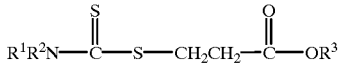

wherein in Formula (B-I), $R^1$, $R^2$, and $R^3$ are independently alkyl groups of 1 to about 4 carbon atoms;

said lubricant or functional fluid being characterized by a phosphorus content of up to about 0.1% by weight.

10. A process for making a lubricant or functional fluid, comprising mixing a major amount of an oil of lubricating viscosity and a minor antiwear amount of:

(A) a zinc salt of a compound represented by the formula (A-IA)

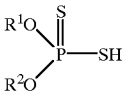

wherein in Formula (A-IA), $R^1$ and $R^2$ are independently isopropyl, n-butyl, isobutyl, amyl, 4-methyl-2-pentyl, isooctyl, decyl, dodecyl, tetradecyl, 2-pentyl, dodecenyl, phenyl, naphthyl, alkylphenyl, alkylnaphthyl, phenylalkyl, naphthylalkyl, alkylphenylalkyl, alkylnaphthylalkyl; and (B) a compound represented by the formula r wherein in Formula (B-IA), $R^1$ and $R^2$ are independently alkyl groups of 4 carbon atoms and $R^3$ is methyl;

said lubricant or functional fluid being characterized by a phosphorus content of up to about 0.1% by weight.

11. A process for making a lubricant or functional fluid, comprising mixing a major amount of an oil of lubricating viscosity and a minor antiwear amount of:

(A) a zinc salt of a compound represented by the formula (A-IA)

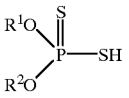

wherein in Formula (A-IA), $R^1$ and $R^2$ are independently isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl; and (B) a compound represented by the formula (B-IA)

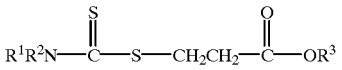

wherein in Formula (-IA), $R^1$ and $R^2$ are alkyl groups of 4 carbon atoms and $R^3$ is methyl;

said lubricant or functional fluid being characterized by a phosphorus content of up to about 0.1% by weight.

12. The composition of claim 1 wherein said composition has a phosphorus content in the range of about 0.02% to about 0.1% by weight.

13. The composition of claim 1 wherein said composition has a phosphorus content of up to about 0.08% by weight.

* * * * *